US007477858B2

(12) United States Patent
Fujii et al.

(10) Patent No.: US 7,477,858 B2
(45) Date of Patent: Jan. 13, 2009

(54) IMAGE FORMING APPARATUS USING A BELT FIXING UNIT

(76) Inventors: Makoto Fujii, c/o Konica Minolta Business Technologies, Inc., 2970 Ishikawa-machi, Hachioji-shi, Tokyo, 192-8505 (JP); Naohiko Hanyu, c/o Konica Minolta Business Technologies, Inc., 2970 Ishikawa-machi, Hachioji-shi, Tokyo, 192-8505 (JP)

( * ) Notice: Subject to any disclaimer, the term of this patent is extended or adjusted under 35 U.S.C. 154(b) by 288 days.

(21) Appl. No.: 11/392,181

(22) Filed: Mar. 29, 2006

(65) Prior Publication Data

US 2007/0019979 A1 Jan. 25, 2007

(30) Foreign Application Priority Data

Jul. 21, 2005 (JP) ..... 2005-211128

(51) Int. Cl.
*G03G 15/20* (2006.01)

(52) U.S. Cl. ..... 399/67; 399/328; 399/329

(58) Field of Classification Search ..... 399/38, 399/67, 107, 122, 320, 328, 329; 219/216
See application file for complete search history.

(56) References Cited

U.S. PATENT DOCUMENTS

| | | | | |
|---|---|---|---|---|
| 6,975,829 | B2 * | 12/2005 | Aruga | 399/329 |
| 7,113,716 | B2 * | 9/2006 | Tomatsu | 399/67 |
| 7,209,697 | B2 * | 4/2007 | Yoshida et al. | 399/329 |
| 7,289,758 | B2 * | 10/2007 | Kim et al. | 399/329 |
| 7,330,688 | B2 * | 2/2008 | Watanabe et al. | 399/329 |

FOREIGN PATENT DOCUMENTS

| | | |
|---|---|---|
| JP | 2004-226815 | 8/2004 |

* cited by examiner

*Primary Examiner*—Hoan H Tran

(57) ABSTRACT

An image forming apparatus may include a belt fixing unit and a controller. The belt fixing unit includes a moving fixing belt heated by a heater, a pressure member provided inside the fixing belt, a pressure roller provided opposite to the pressure member through the fixing belt to form a nip portion, a transfer material having a toner image thereon passing the nip portion and thereby the toner image being fixed on the transfer material, and a pressing force change unit capable of changing a pressing force of the pressure member against the pressure roller. The controller controls the pressing force change unit to change the pressing force according to print information for both faces of the transfer material.

10 Claims, 8 Drawing Sheets

PRESSURE FORCE: SMALL

PRESSURE FORCE: MEDIUM

PRESSURE FORCE: LARGE

IMAGE FORMING APPARATUS USING A BELT FIXING UNIT

This application is based on Japanese Patent Application No. 2005-211128 filed on Jul. 21, 2005, which is incorporated hereinto by reference.

BACKGROUND OF THE INVENTION

The invention relates to an image forming apparatus such as a copying machine, printer, and the like and particularly, to an image forming apparatus which uses a belt fixing unit.

An electrophotographic image forming apparatus forms a toner image on an image carrier, transfers the toner image to a transfer material by a transfer unit, fixes the image on the transfer material at a nip portion which is formed by a heating member and a pressing member in a fixing unit, and delivers the fixed transfer material to the outside of the apparatus.

Recently, image forming apparatus have been requested to process color images at high speed. To meet such a request, the fixing unit in the image forming apparatus must widen the width of the nip portion to take time for transfer materials to pass through the nip portion.

When the fixing unit is of a roller type which uses fixing rollers and pressure rollers, the diameters of the rollers must be greater to prolong the time during which transfer materials pass through the nip portion. However, this will enlarge the fixing unit and consequently make the image forming apparatus greater.

If the elastic surface layer of the fixing roller is made thicker to ensure the width of the nip portion, the rate of heat transfer from the heat source to the surface layer of the fixing roller will be reduced and the warm-up time will become longer. As the result, this will reduce the printing speed and will not be fitted for high-speed printing.

To solve such a problem in the roller type fixing unit, a fixing belt type fixing unit has been proposed which presses a heated fixing belt against a pressure roller to assure a great nip width.

The image forming apparatus has been also requested to satisfy the other demands such as two-sided printing of transfer materials in addition to high-speed color image printing.

In two-sided printing, when unfixed toner on the first face is fixed, the transfer material has a force to be attached to or wound on the fixing belt. When the transfer material is inverted upside down and unfixed toner on the second face is fixed, the transfer material concurrently has a force to be attached to the pressure roller due to the toner on the first face. The direction of this attaching force to or winding on the fixing belt or to the pressure roller depends on the print density of two faces and quantity of toner adhered to two faces.

As explained above, since the direction of the attaching or winding force of the transfer material to the fixing belt or to the pressure roller depends on the print state of the first and second faces of the transfer material, sheet separation claws are provided in contact with the fixing belt and the pressure roller to prevent the transfer material from attaching thereto.

However, the separation claws may possibly cause damages on members with which the claws are in contact and unevenness in image gloss on the image obtained. The following technology (for example, Patent Document 1) without separation claw has been proposed to solve such problems, that is, to perform two-sided printing without unwanted sheet attaching to the fixing belt and the pressure roller.

That is, a belt-type fixing unit has an endless fixing belt which is entrained about a support roller and a heating roller, and a pressure roller which is provided opposite to the support roller through the fixing belt to press against the support roller. A pressure nip portion is formed between the pressure roller and the fixing belt, and a transfer material with an unfixed toner image is conveyed to pass through this nip portion for fixing. This technology is characterized in that the section of the nip portion shows an approximate straight line to prevent a two-sided copying sheet from attaching to the belt and the pressure roller. [Patent Document 1]: Japanese Unexamined Patent Publication 2004-226815

However, since the technology disclosed by Patent Document 1 limits the sectional shape of the pressure nip portion to an almost straight line shape, this configuration cannot solve the sheet attaching problem if the printed faces have different print densities thereon and toner quantities adhered thereto.

Further, materials, shapes, and other conditions of the fixing belt, the support roller, and the pressure roller must be limited to some extent to make the cross-section of the pressure nip portion almost linear. This may reduce the degrees of freedom of designing of the fixing unit.

SUMMARY OF THE INVENTION

The invention has been made in view of the above problems and an object of the invention is to provide an image forming apparatus equipped with a high-reliability belt fixing unit which reduces a sheet attaching or winding problem even in two-sided printing mode.

The object of the invention can be accomplished by the following structure.

An image forming apparatus comprises a belt fixing unit and a controller.

The belt fixing unit includes a moving fixing belt heated by a heater, a pressure member provided inside the fixing belt, a pressure roller provided opposite to the pressure member through the fixing belt to form a nip portion, a transfer material having a toner image thereon passing the nip portion and thereby the toner image being fixed on the transfer material, and a pressing force change unit capable of changing a pressing force of the pressure member against the pressure roller.

The controller controls the pressing force change unit to change the pressing force according to print information for both faces of the transfer material.

Figure 7:
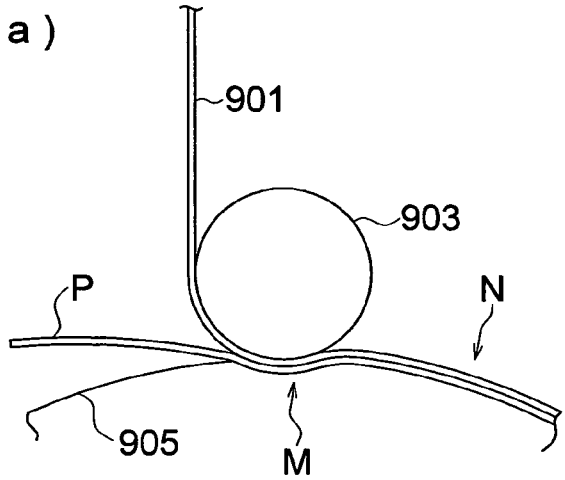
Figure 7:
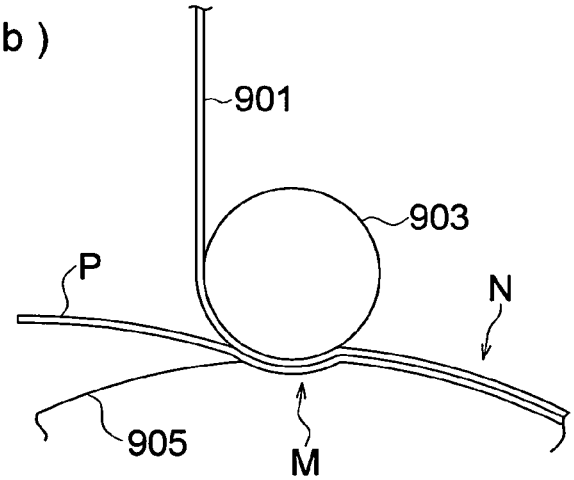
Figure 7:
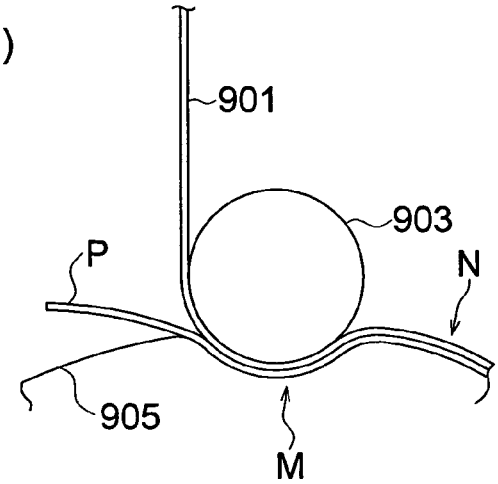
Figure 8:
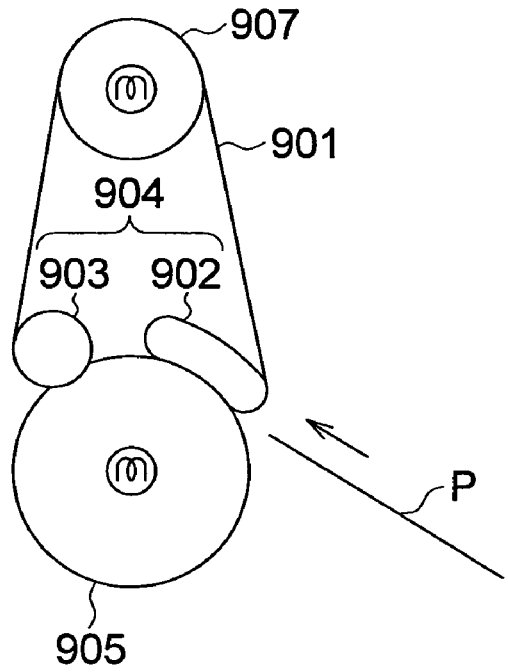
Figure 9:
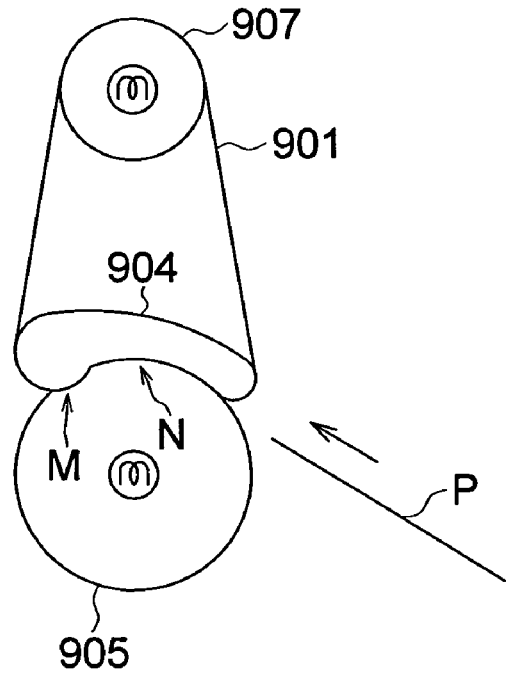
Figure 10:
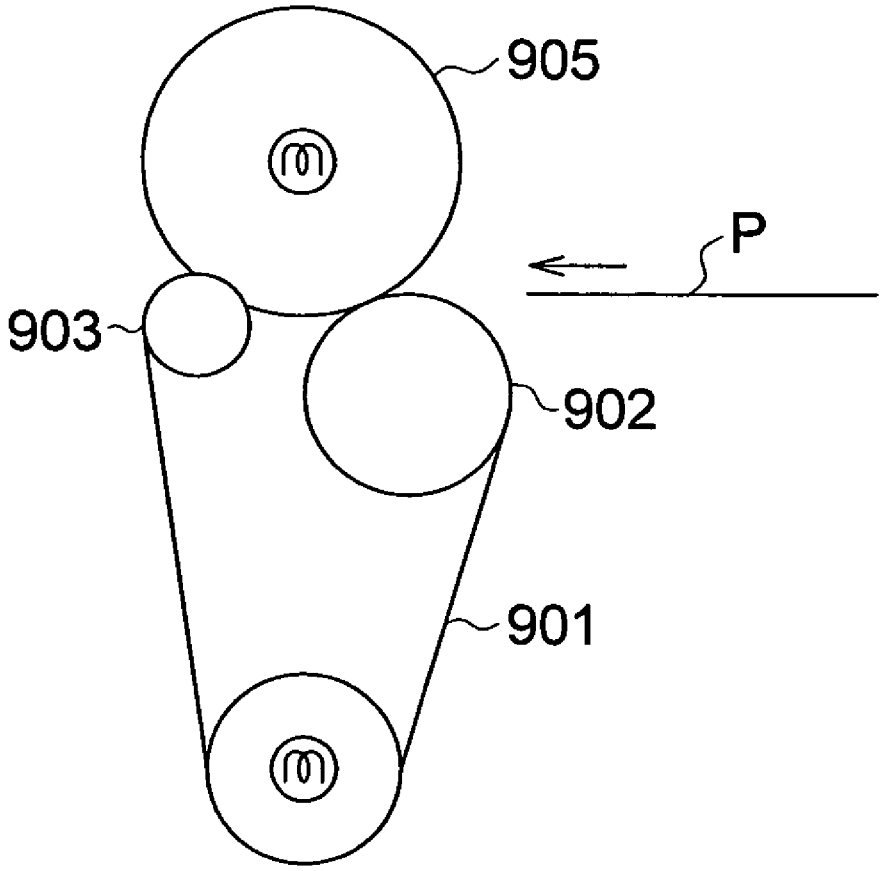

Each of FIG. 7(*a*) to FIG. 7(*c*) is a drawing which explains that the circumferential surface of the pressure roller is dented concavely towards the center of the pressure roller near exit M of nip portion N;

FIG. 8 is a schematic sectional view of a belt fixing unit which is a second embodiment of the invention;

FIG. 9 is a schematic sectional view of a belt fixing unit which is a third embodiment of the invention; and FIG. 10 is a schematic sectional view of a belt fixing unit which is a fourth embodiment of the invention.

DETAILED DESCRIPTION OF THE PREFERRED EMBODIMENT

Embodiments of the invention will be explained below with reference to the accompanying drawings. It is to be expressly understood, however, that the embodiments are not intended as a definition of the limits of the technical ranges and terms given in claims. Further, it is to be expressly understood that the predicative explanations of the embodiments of the invention are for best modes and are not intended as a definition of the limits of the terms and technical ranges of the invention.

Figure 1:
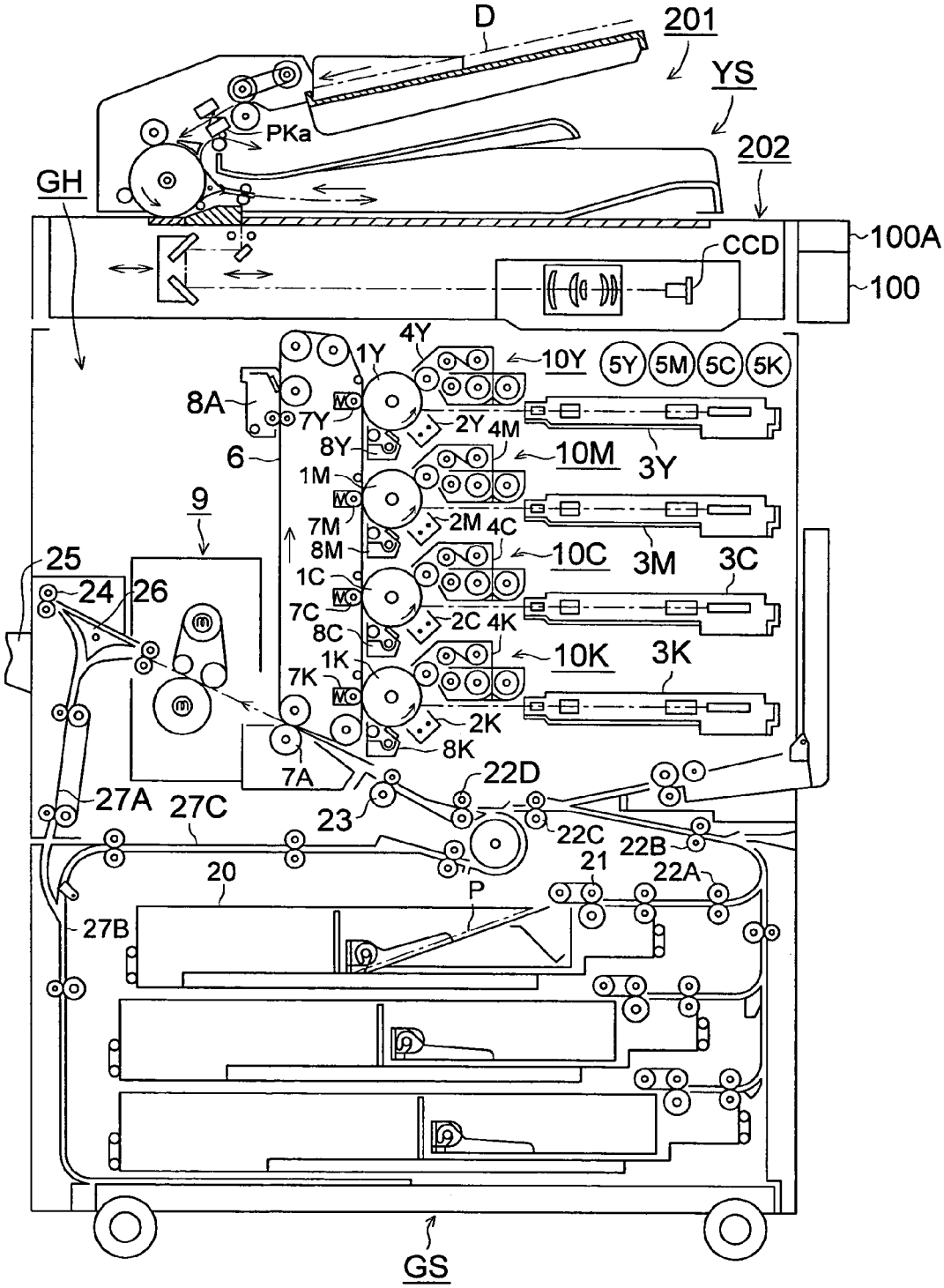
FIG. 1 is a schematic configuration of an image forming apparatus.

There will be explained below an image forming apparatus equipped with a belt fixing unit in accordance with the invention with reference to FIG. 1. FIG. 1 is a schematic configuration of an image forming apparatus.

In FIG. 1, image forming apparatus GS is constituted by main body GH of the image forming apparatus and image reading device YS.

Main body GH of the image forming apparatus is generically called a tandem type color image forming apparatus and is constituted by multiple image forming units 10Y, 10M, 10C, and 10K, a belt-shaped intermediate transfer member 6, a sheet feed and conveyance device, and a belt fixing unit 9.

Image reading device YS comprising automatic document feeder 201 and document image scanning and exposing unit 202 is placed on the top of main body GH of the image forming apparatus. Document D placed on the document tray of automatic document feeder 201 is delivered to document image scanning and exposing unit 202 by a conveyance device. One-sided or two-sided faces of the document are exposed and scanned by the optical system of document image scanning and exposing unit 202 and read into a line image sensor CCD (Charge Coupled Device).

Line image sensor CCD photo-electrically converts light into analog signals and sends the signals to an image processor for analog processing, A/D conversion, shading correction, image compression, etc. After processing, the resulting image data is temporarily stored in memory and then sent to image writing section (or exposure units) 3Y, 3M, 3C, and 3K. The image writing'section expose images on the photoreceptor drum according to image data of respective colors.

Image forming unit 10Y to form yellow (Y) images is equipped with photoreceptor drum 1Y as an image carrier and its peripheral units such as charger 2Y, exposure unit 3Y, developing unit 4Y, and cleaning unit 8Y. Image forming unit 10M to form magenta (M) images is equipped with photoreceptor drum 1M as an image carrier and its peripheral units such as charger 2M, exposure unit 3M, developing unit 4M, and cleaning unit 8M. Image forming unit 10C to form cyan (C) images is equipped with photoreceptor drum 1C as an image carrier and its peripheral units such as charger 2C, exposure unit 3C, developing unit 4C, and cleaning unit 8C. Image forming unit 10K to form black (K) images is equipped with photoreceptor drum 1K as an image carrier and its peripheral units such as charger 2K, exposure unit 3K, developing unit 4K and cleaning unit 8K. The above chargers (2Y, 2M, 2C, and 2K) and exposure units (3Y, 3M, 3C, and 3K) constitute a latent image forming unit.

Developing units 4Y, 4M, 4C, and 4K respectively contain a two-component developer of respective colors (yellow (Y), magenta (M), cyan (C) and black (K)). Each two-component developer is made of fine toner particles and carriers of the color.

Intermediate transfer member 6 is entrained about plural rollers and is ratably supported thereby.

Y, M, C, and K color images formed by image forming units 10Y, 10M, 10C and 10K are transferred (primary transfer) onto intermediate transfer member 6 sequentially by transfer units 7Y, 7M, 7C and 7K to form a composite color image. Recording sheet P as a transfer material is taken out from sheet feed cassette 20 by sheet feed unit 21, delivered to transfer unit 7A by sheet feed rollers (22A, 22B, 22C, and 22D) and registration rollers 23, and receives a composite color image on its surface (secondary transfer). Recording sheet P with a transferred color image is sent to nip portion N formed in belt fixing unit 9, heated and pressed there to fix the color toner image (or toner image) on the surface of sheet P, delivered by sheet ejection rollers 24 in the sheet ejection path, and ejected on sheet stacking tray 25 outside the image forming apparatus.

In two-sided printing mode, after a color image (or a color toner image) is formed on one face (front or first face) of sheet P and fixed by belt fixing unit 9, sheet P is branched from the sheet ejection path by branching member 26 to a sheet re-feeding mechanism (ADU mechanism) via a lower sheet circulation path 27A, turned upside down by sheet inversion path 27B in the ADU mechanism, and delivered to the normal sheet feed path which receives and passes sheet P from sheet feed cassette 20 by sheet feed rollers 22D via sheet re-feeding section 27C.

The inverted and conveyed recording sheet P (inverted recirculation) is sent to secondary transfer roller 7A via registration roller 23 and receives a composite color image (or color toner image) on the other face (back or second face) of sheet P from secondary transfer roller 7A. Recording sheet P with another transferred color image is fixed by belt fixing unit 9, delivered by sheet ejection rollers 24 in the sheet ejection path, and ejected to sheet stacking tray 25 outside the image forming apparatus.

Meanwhile, after transferring a color image onto recording sheet P by transfer unit 7A and separating recording sheet P by small radius of transfer unit 7A, intermediate transfer member 6 is cleaned to remove residual toner by cleaning unit 8A.

Figure 2:
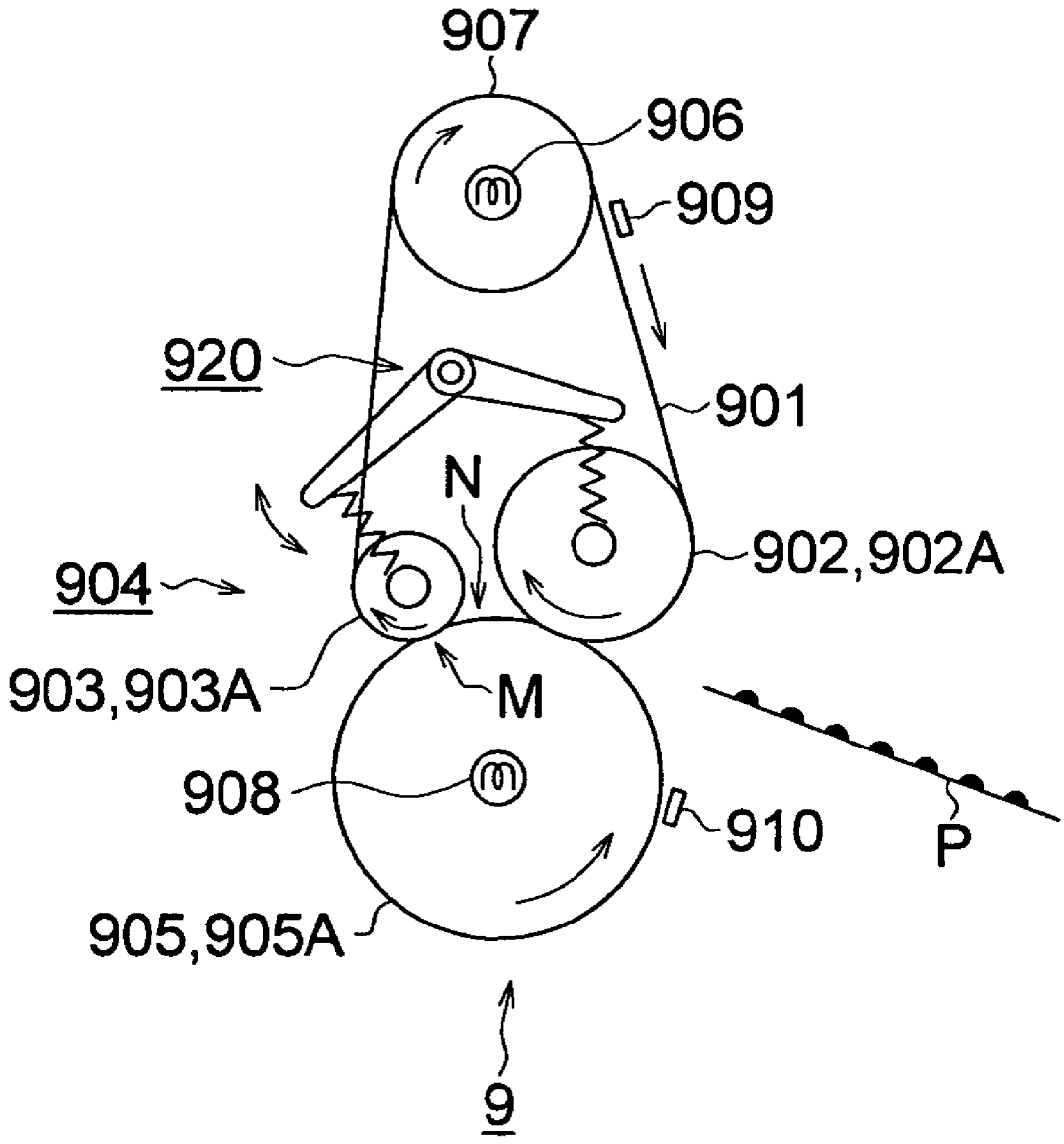
FIG. 2 is a schematic sectional view of a belt fixing unit which is a first embodiment of the invention.

Next, there will be explained an example (as a first embodiment) of belt fixing unit for the image forming apparatus with reference to FIG. 2. FIG. 2 is a schematic sectional view of a belt fixing unit which is a first embodiment of the invention.

Belt fixing unit 9 is constituted by fixing belt 901, pressure member 904 which includes main pressure roller 902 as a main pressure member provided inside the loop of fixing belt 901 and exit pressure roller 903 as an exit pressure member provided in the downstream side of main pressure roller 902 along the conveyance direction of recording sheet P, pressure roller 905 provided opposite pressure member 904 through fixing belt 901 placed therebetween, heating roller 907 which houses heater 906 as a heating member and supports fixing belt 901, and pressing force change unit 920 which presses pressure member 904 against pressure roller 903.

In this embodiment, pressure roller 905 also contains heater 908. Temperature detectors 909 and 910 provided in non-contact or in contact with fixing belt 901 and pressure roller 905, respectively, in order to maintain the surface temperatures of fixing belt 901 and pressure roller 905 in respective proper temperatures for fixing. Heaters 906 and 908 are controlled by controller 100 (see FIG. 1) of the image forming apparatus according to detected signals sent from temperature detectors 909 and 910.

Heating roller 907 is rotated in the arrow direction by a drive member which is not shown in the figure. Consequently, this rotation causes fixing belt 901, main pressure roller 902, exit pressure roller 903, and pressure roller 905 to rotate respectively in arrow directions.

N is nip portion formed by bringing pressure member 904 into contact with pressure roller 905 through fixing belt 901.

There will be explained materials and shapes of major members as follows.

Fixing belt 901 is an endless belt which is made of a metallic base or heat-resistant resin base coated with a releasing layer which mainly contains fluorine or silicone resin.

Main pressure roller 902 and exit pressure roller 903 are hard rollers which are prepared by coating the outer circumferences of cylindrical metal pipes with elastic silicone rubber layers 902A and 903A. The cylindrical metal pipes can be made of SUS (stainless steel) or the like.

Pressure roller 905 is a soft roller prepared by coating the outer circumference of a cylindrical metal pipe with an elastic silicone rubber or silicone rubber sponge layer 905A and further covering the outer surface with a PFA (perfluoroalkoxy) tube.

Again in the configuration, since pressing force change unit 920 presses exit pressure roller 903, fixing belt 901 is constituted such that fixing belt 901 is curved convexly towards the center of pressure roller 905 in the vicinity of exit M of nip portion N, that is, a position where exit pressure roller 903 is in contact with pressure roller 905. In other words, the surface of pressure roller 905 is curved concavely towards the center of pressure roller 905 in the vicinity of exit M of nip portion N through fixing belt 901 by making pressing force change unit 920 to press exit pressure roller 903.

The convex curvature of fixing belt 901, that is, the concave curvature of the surface of pressure roller 905 can be attained, for example, by making elastic layer 903A of exit pressure roller 903 harder than elastic layer 905A of pressure roller 905. However, the curvature formation is not limited to the above. The concave curvature can be formed on the surface of pressure roller 905 for example by using a metallic exit pressure roller 903.

Figure 3:
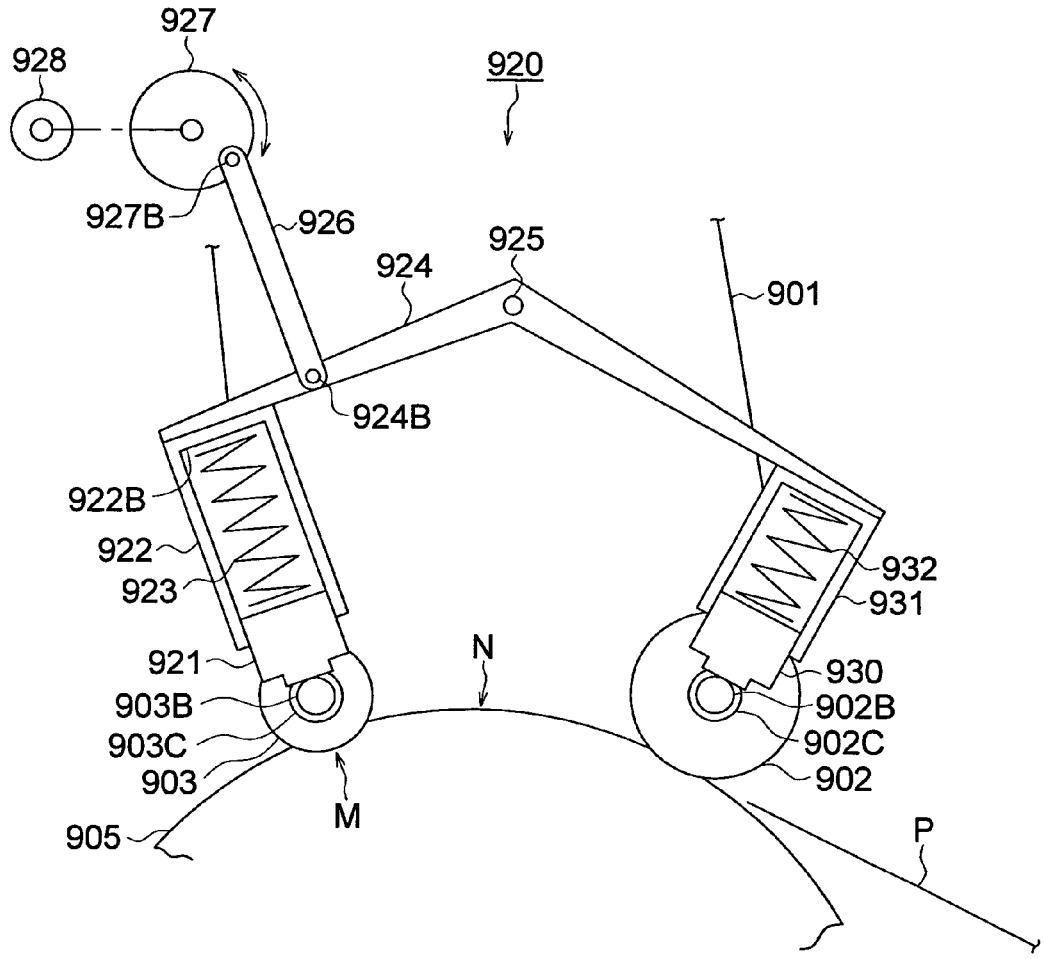
FIG. 3 is a sectional view of a major part of a pressing force change unit.

Next, there will be explained the details of pressing force change unit 920 with reference to FIG. 3. FIG. 3 is a sectional view of a major part of the pressing force change unit 920.

Numeral 903B is the exit side supporting shaft to rotatably support the exit pressure roller 903 through bearing member 903C.

Numeral 921 is the exit side contact member which is slidably supported in the inner cylinder of exit side cylinder 922, and in contact with the end of exit supporting side shaft 903B that is urged by exit side compression spring 923 provided between exit side contact member 921 and bottom 922B of exit side cylinder 922.

Numeral 924 is the V-shaped swing lever which can rotate about supporting shaft 925. One end of the lever is fixed to the bottom of exit cylinder 922 as shown in FIG. 3.

Numeral 926 is the coupling rod, one end of which is pivotably connected to pin 924B on swing lever 924. The other end of coupling rod 926 is pivotably connected to pin 927B, which is provided eccentrically on disk 927.

Numeral 928 is a pressing force change motor, which rotates disk 927 through a transmission, which is not shown in the figure.

Similarly to exit pressure roller 903 as apparent from the figure, main pressure roller 902 is urged against pressure roller 905 since main pressure side supporting shaft 902B is pressed by a pressure force transmission device which is constituted by main pressure side contact member 930, main pressure side cylinder 931, and main pressure side compression spring 932.

The bottom of main pressure side cylinder 931 is fixed on the other end of swing lever 924 opposite to the exit side cylinder 922.

Incidentally, each member mentioned above including exit side cylinder 922 and main pressure side cylinder 931 is arranged on both ends of exit pressure roller 903 and main pressure roller 902 in the axis direction, respectively.

Next, there will be explained the operation of pressing force change unit 920. When pressing force change motor 928 rotates a preset angle, disk 927 rotates and swing lever 924 swings. By this swing, exit side compression spring 923 is compressed and consequentially, the pressing force of exit side pressure roller 903 varies. In other words, the quantity of intrusion of roller 903 into pressure roller 905 varies and the degree of concave dent in the surface of pressure roller 905 varies at position M where exit side pressure roller 903 of nip portion N is in contact with pressure roller 905.

Similarly, the pressing force of main pressure roller 902, or the quantity of intrusion of fixing belt 901 into pressure roller 905 changes as pressure force change motor 928 rotates.

As apparent from the above description, exit pressure roller 903 and main pressure roller 902 behave oppositely on pressure roller 905. When the pressing force of exit pressure roller 903 increases, the pressing force of main pressure roller 902 decreases, and vice versa.

Next, there will be explained the control to change pressing forces of exit pressure roller 903 and main pressure roller 902 when fixing unfixed toners on first and second faces of recording sheet P with reference to FIGS. 4 and 5.

Figure 4:
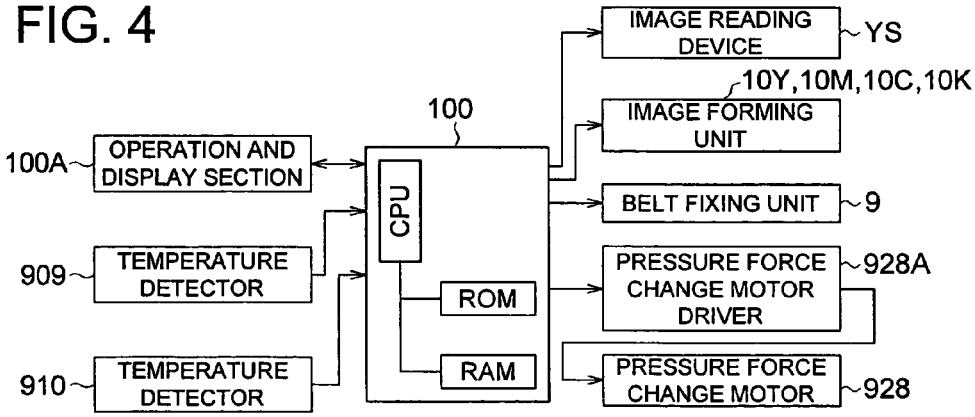
FIG. 4 is a control block diagram of an image forming apparatus which contains the pressing force change unit.
Figure 5:
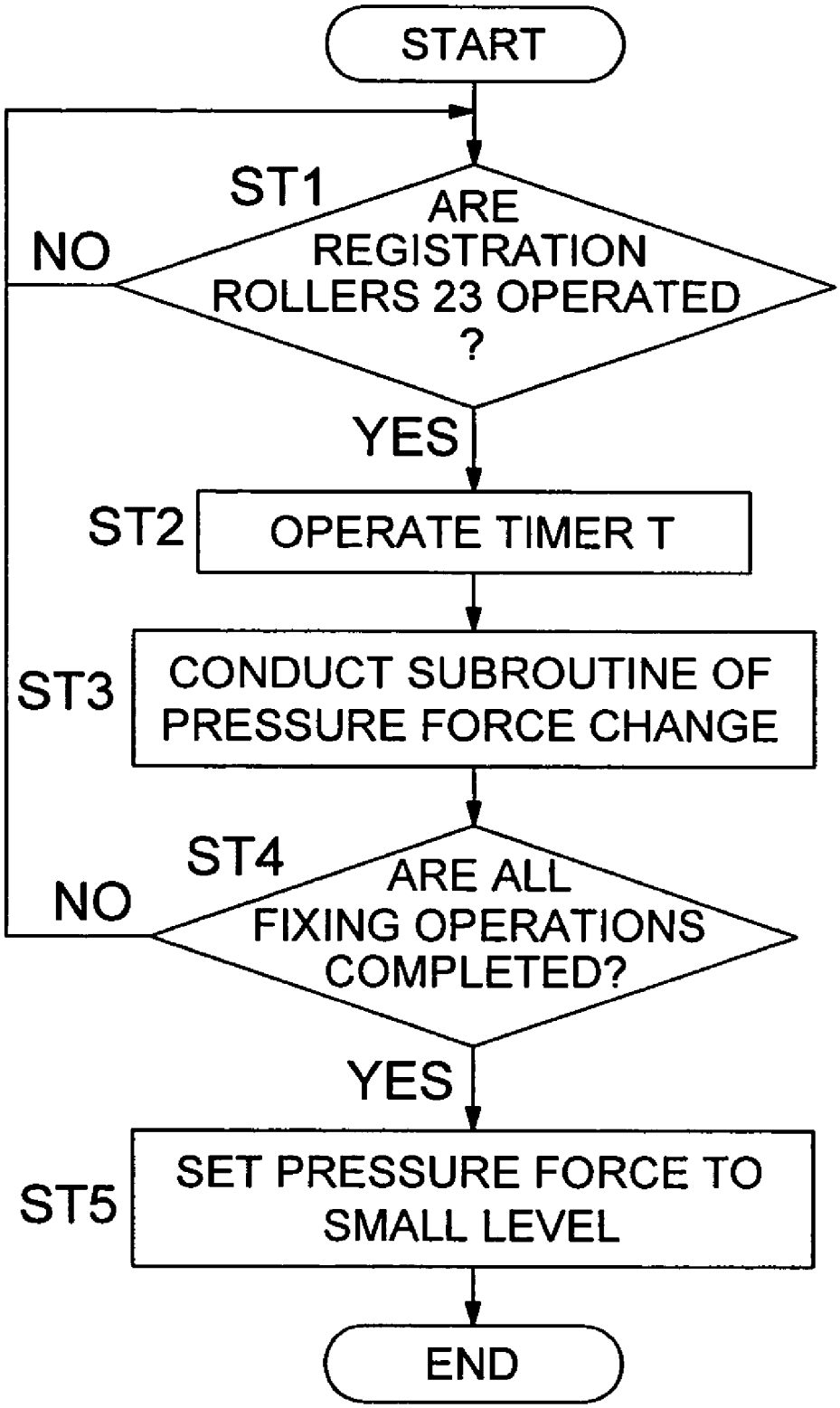
FIG. 5 is a control flow chart of the pressing force change unit.

FIG. 4 is a control block diagram of controller 100 in the image forming apparatus which contains the pressing force change unit 920. FIG. 5 is a control flow chart of pressing force change unit 920.

In FIG. 4, controller 100 is constituted by CPU for computing and memory units such as ROM and RAM to store data of image densities of images (print density) which are read by an image reading device YS.

The print density implies a ratio of the fixed toner area to the transfer material area.

Operation and display unit 100A is connected to controller 100 to display the image forming status of error positions and enable the operator to set and select data such as setting the number of copies, selection of one-sided or two-sided copy, and setting a sheet thickness.

Controller 100 controls operations of image reading device YS, image forming units (10Y, 10M, 10C, and 10K), belt fixing unit 9, and other units according to programs stored in memory ROM.

Further, controller 100 controls the drive of pressure force change motor 928 through pressing force change motor driver 928A.

Next, there will be explained a control flow of pressing force change unit 920 with reference to FIG. 5.

When an image formation starts and recording sheet P fed from sheet feed cassette 20 by sheet feed unit 21 reaches registration roller 23, controller 100 checks whether registration roller 23 has started to rotate (ST1). When YES, controller 100 waits a preset time period by timer T (ST2), that is, until the leading edge of recording sheet P reaches a predetermined position before belt fixing unit 9. Then controller 100 executes a pressing-force-change subroutine program (ST3).

There will be explained below the processing of the pressing force change subroutine program at ST3 with reference to the flow chart of FIG. 6.

First, controller 100 checks which face of first or second face of recording sheet is to be fixed (ST31). When the first face is to be fixed, the controller 100 drives pressure force change motor 928 to set the pressing force of exit pressure roller 903 to small (ST32), ends the subroutine program, and goes to Step ST4 (in FIG. 5). At ST4, controller 100 checks whether all fixing is completed. When YES, controller 100 sets to set the pressing force (ST5) to small, ends the subroutine program, and waits until the next image formation starts.

It is to give no unwanted pressing force to fixing belt 901, exit pressure roller 903, and pressure roller 905 that the pressing force is set to small in the waiting state.

Returning to FIG. 6, when NO at ST31, that is, when the second face of recording sheet P is to be fixed, controller 100 then checks whether or not recording sheet P is thick (ST33). When YES, controller 100 goes to Step ST32 and performs the operation of Step ST32.

When NO, i.e., when the sheet is not thick, controller 100 checks whether or not the print density of the leading edge and its vicinity of the second face of recording sheet P is greater than that of the first face (ST34). When YES, controller 100 goes to Step ST32, to set the pressing force to small, and goes to Step ST4. When NO at ST34, controller 100 checks whether or not the print density of the leading edge and its vicinity of the second face of recording sheet P is equal to that of the first face (ST35). When YES, controller 100 sets the pressing force to medium (ST36) and goes to Step ST4 in FIG. 5. When NO at ST35, controller 100 sets the pressing force to large (ST37) and goes to Step ST4 in FIG. 5.

Incidentally, in this embodiment, the border whether recording sheet P is thick or not is decided by weight of recording sheet of 80 g/m$^2$ or more for "thick" sheet and less than 80 g/m$^2$ for "not thick" sheet. The border can be set experimentally.

Leading edge of recording sheet P in this embodiment implies a marginal area of 10 to 20 mm long relative to the leading edge of the sheet. It is also possible to set the border of the leading edge experimentally.

Next, there will be explained pressing force levels "Small," "Medium," and "Large" with reference to FIG. 7(*a*) to FIG. 7(*c*).

FIG. 7(*a*) to FIG. 7(*c*) show that exit pressure roller 903 makes the circumferential surface of the pressure roller 905 through fixing belt 901 to be dented concavely towards the center of the pressure roller 905 in the vicinity of exit M of nip portion N.

FIG. 7(*a*) shows application of "Small" pressing force. This status is accomplished when pressing force change unit 920 presses exit pressure roller 903 with a little force.

Figure 6:
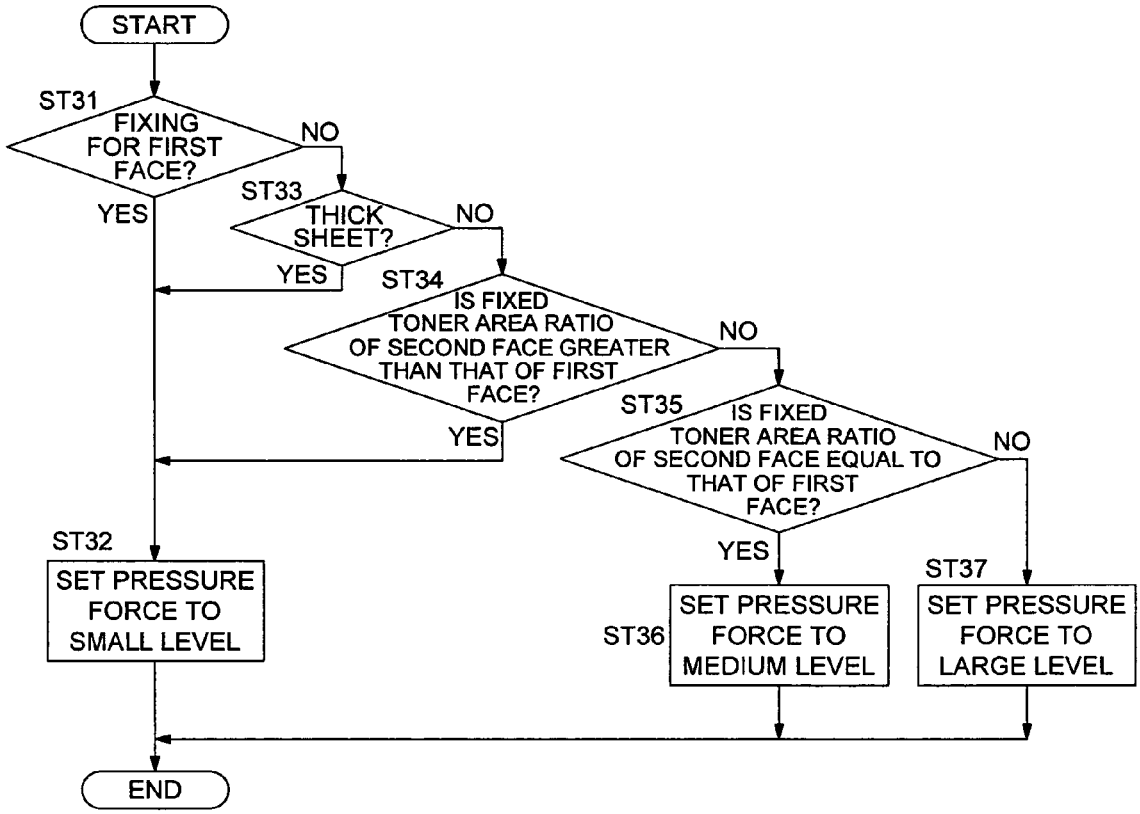
FIG. 6 is an operation flow chart of a subroutine for the pressing force change unit.

As explained in FIG. 6, the "Small" pressing force is applied when the first face of recording sheet P is fixed, when recording sheet P is thick, or when the print density on the leading edge of the second face is greater than that of the first face. When the first face of recording sheet P is fixed or when the print density on the leading edge of the second face is greater than that of the first face, recording sheet P is usually likely to attach to or winding on the surface of fixing belt 901, but the sheet can be separated by a curvature of fixing belt 901. Therefore, even when the pressing force is "Small" the sheet will not be wound to fixing belt 901 and pressure roller 905. Further, when recording sheet P is thick, the sheet will not cause winding in any pressing force status because the rigidity of the sheet is great. However, when the pressing force is "Small" no excessive force will be applied to fixing belt 901, exit pressure roller 903, and pressure roller 905. This is preferable.

FIG. 7(*b*) shows application of "Medium" pressing force. This status is accomplished when pressing force change unit 920 presses exit pressure roller 903 with a medium force.

As explained in FIG. 6, when the second face of a non-thick recording sheet is to be fixed and the print density on the leading edge of the second face is equal to that of the first face, the recording sheet may possibly attach to or winding on both fixing belt 901 and pressure roller 905. However, when a "Medium" pressing force is applied, the recording sheet is easily separated by the curvatures of fixing belt 901 and pressure roller 905 near exit M and will not be wound to either of them.

FIG. 7(*c*) shows application of "Large" pressing force. This status is accomplished when pressing force change unit 920 presses exit pressure roller 903 with a large force.

As explained in FIG. 6, when the second face of a non-thick recording sheet is to be fixed and the print density on the leading edge of the second face is smaller than that of the first face, the pressing force is set to the "Large" position. This increases the curvature of pressure roller 905 near exit M. This increased curvature facilitates separation of sheet from pressure roller 905 and no winding of sheet occurs.

As explained above, the pressing force of the exit pressure roller is varied depending upon various conditions, print problems such as fixing irregularity, gloss irregularity, and image shifting will not be caused by changes in fixing conditions of the first and second faces because the total of the two pressing forces are approximately constant by the action of swing lever 924 of pressing force change unit 920.

It is also possible to change the pressing force separately on exit pressure roller 903 and on main pressure roller 902.

Further, since almost all fixing is performed by the nip portion of main pressure roller 902, it is possible, in some cases, to change only the pressing force of exit pressure roller 903 while keeping the pressing force constant on main pressure roller 902. In such a case, it may be good to change only the pressing force of exit pressure roller 903 while keeping the pressing force constant on main pressure roller 902.

Prevention of winding of recording sheet P can be accomplished also by structures other than those explained above. Such structures will be explained below in reference FIG. 8, FIG. 9, and FIG. 10.

First, there will be explained a second embodiment of the invention, referring to FIG. 8.

As shown in FIG. 8, pressure member 904 is constituted by exit pressure roller 903 and stationary main press member 902. Pressure member 904 presses exit pressure roller 903 and main press member 902 in the same manner as the first embodiment (see FIG. 3).

A third embodiment of the invention will be explained below referring to FIG. 9.

As shown in FIG. 9, pressure member 904 is constituted by only one stationary member. The part of pressure member 904 is projected convexly near exit M of nip portion N so as to press the surface of pressure roller 905 toward the center of roller 905 through fixing belt 901.

Pressure member 904 is pressed in the manner similar to the first embodiment (FIG. 3).

A fourth embodiment of the invention will be explained below referring to FIG. 10.

As apparent from FIG. 10, the structure of this embodiment turns the structure of FIG. 1 upside down. Exit pressure roller 903 and main press member 902 are pressed in the manner similar to the first embodiment (FIG. 3).

In addition, first embodiment uses three print density levels near the leading edge of a transfer material, two sheet thickness levels, and three pressing force levels. However, the invention is not limited to these levels. The levels can be set to more or continuous levels.

Further, the first embodiment uses the print density near the leading edge of each transfer material as print information. However, the invention is not limited to such print information. The print information can contain the print density of the whole transfer material, the quantity of adhered toner, or both.

As explained above, the following effects can be obtained by the above embodiments.

The embodiments can provide an image forming apparatus which can prevent winding of transfer materials on the fixing belt and the pressure roller even when print copies of different information values, e.g. print densities and quantities of adhered toner, are done by changing the pressing force of the pressure member according to the print information for both sides of each transfer material and changing the degree of curvatures of the fixing belt and the surface of the pressure roller which are dented concavely toward the center of the pressure roller.

By using print information densities near the leading edge of each face of transfer material as print information, this embodiment can prevent sheet winding problems steadily.

By using print densities of the first and second faces which greatly affect winding of sheet as print information, this embodiment can prevent sheet winding problems steadily.

By adding information of the pressure member pressing forces and sheet thickness information to print information, this embodiment can prevent sheet winding problems steadily even when sheets of different thicknesses are used.

By dividing the pressure member into main pressure member and an exit pressure member which is provided in the downstream side of the main press member along the conveyance direction of transfer materials, the belt fixing unit can have different functions, for example, a function of causing the main pressure member to fix and the exit pressure member to prevent sheet winding failure. This functional separation can greatly improve the fixing performance and winding prevention of the belt fixing unit.

Since the pressing force change unit is so constructed to decrease (increase) the pressing force on the main pressure member according to the increase (decrease) of the pressing force on the exit pressure member, the fixing unit can keep the fixing conditions constant.

What is claimed is:

1. An image forming apparatus comprising:

(a) a belt fixing unit including:

a moving fixing belt heated by a heater, a pressure member provided inside the fixing belt, a pressure roller provided opposite to the pressure member through the fixing belt to form a nip portion, a transfer material having a toner image thereon passing the nip portion and thereby the toner being fixed on the transfer material, and a pressing force change unit capable of changing a pressing force of the pressure member against the pressure roller; and (b) a controller which controls the pressing force change unit to change the pressing force according to print information for both faces of the transfer material, wherein the pressure member makes a surface of the pressure roller to be concavely curved toward a center of the pressure roller through the moving fixing belt.

2. The image forming apparatus of claim 1, wherein the print information is print densities in the vicinity of a leading edge of the transfer material.

3. The image forming apparatus of claim 1, wherein the print information is the information based on a print density of a first face and a print density of a second face of the transfer material.

4. The image forming apparatus of claim 1, where the pressing force is changed according to the print information and thickness information of the transfer material.

5. The image forming apparatus of claim 1, where the pressure member includes a main pressure member and an exit pressure member provided downstream of the main pressure member in a conveyance direction of the transfer material.

6. The image forming apparatus of claim 5, wherein the pressing force change unit is structured so that the pressing force of the main pressure member is increased corresponding to a decrease of the pressing force of the exit pressure member, and the pressing force of the main pressure member corresponding to an increase of the pressing force of the exit pressure member.

7. The image forming apparatus of claim 6, wherein the pressing force change unit having a swing lever and springs, and the main pressure member is connected to one side of the swing lever and the exit pressure member is connected to another side of the swing lever.

8. The image forming apparatus of claim 1, wherein the print information corresponds to a print density.

9. An image forming apparatus comprising:

(a) a belt fixing unit including:

a moving fixing belt heated by a heater, a pressure member provided inside the fixing belt, a pressure roller provided opposite to the pressure member through the fixing belt to form a nip portion, a transfer material having a toner image thereon passing the nip portion and thereby the toner being fixed on the transfer material, and a pressing force change unit capable of changing a pressing force of the pressure member against the pressure roller; and (b) a controller which controls the pressing force change unit to change the pressing force according to print information for both faces of the transfer material, wherein the print information is print densities in the vicinity of a leading edge of the transfer material.

10. An image forming apparatus comprising:

(a) a belt fixing unit including:

a moving fixing belt heated by a heater, a pressure member provided inside the fixing belt, a pressure roller provided opposite to the pressure member through the fixing belt to form a nip portion, a transfer material having a toner image thereon passing the nip portion and thereby the toner being fixed on the transfer material, and a pressing force change unit capable of changing a pressing force of the pressure member against the pressure roller; and (b) a controller which controls the pressing force change unit to change the pressing force according to print information for both faces of the transfer material, where the pressing force is changed according to the print information and thickness information of the transfer material.

* * * * *